US007125415B1

(12) United States Patent
Hudgens

(10) Patent No.: US 7,125,415 B1
(45) Date of Patent: Oct. 24, 2006

(54) NECK TRACTION SYSTEM

(76) Inventor: William Hudgens, 43 Sunset Dr., Englewood, CO (US) 80110

( * ) Notice: Subject to any disclaimer, the term of this patent is extended or adjusted under 35 U.S.C. 154(b) by 94 days.

(21) Appl. No.: 10/744,352

(22) Filed: Dec. 22, 2003

(51) Int. Cl.
*A61H 1/02* (2006.01)

(52) U.S. Cl. ..... 606/241; 602/32

(58) Field of Classification Search ..... 602/13, 602/17, 18, 32, 33, 34, 35, 36, 38, 74; 601/38, 601/39; 606/237, 240, 241, 242; 128/845; 5/603, 622, 636, 637, 640, 643; 482/10, 482/40, 904
See application file for complete search history.

(56) References Cited

U.S. PATENT DOCUMENTS

| | | | | | |
|---|---|---|---|---|---|
| 738,283 | A | * | 9/1903 | Blomqvist | 606/237 |
| 1,356,365 | A | * | 10/1920 | Hosmer | 602/32 |
| 1,425,433 | A | | 8/1922 | Zook | |
| 2,642,927 | A | * | 6/1953 | Rising | 297/398 |
| 2,658,506 | A | | 11/1953 | Haskell | |
| 2,701,564 | A | | 2/1955 | Wilhelm | |
| 2,808,049 | A | | 10/1957 | Graham | |
| 2,843,114 | A | | 7/1958 | Hall | |
| 2,938,695 | A | | 5/1960 | Ciampa | |
| 3,105,489 | A | | 10/1963 | Zivi | |
| 3,114,366 | A | | 12/1963 | Maychark | |
| 3,403,675 | A | | 10/1968 | Carr | |
| 3,596,655 | A | * | 8/1971 | Corcoran | 602/32 |
| 3,654,922 | A | | 4/1972 | Outcalt | |
| 3,675,646 | A | * | 7/1972 | Corcoran | 602/32 |
| 3,750,658 | A | | 8/1973 | Dawson, Jr. et al. | |
| 3,759,255 | A | | 9/1973 | Taylor | |
| 4,869,240 | A | | 9/1989 | Boren | |
| D344,135 | S | | 2/1994 | Price | |
| 5,540,643 | A | * | 7/1996 | Fontaine | 602/36 |
| 5,658,245 | A | | 8/1997 | McGinnis et al. | |
| 5,662,597 | A | * | 9/1997 | Chitwood | 602/32 |
| 5,713,841 | A | | 2/1998 | Graham | |
| 5,916,188 | A | | 6/1999 | Ousdal | |
| 6,016,807 | A | | 1/2000 | Lodge | |
| 6,217,538 | B1 | * | 4/2001 | Anderson | 602/35 |
| 6,517,506 | B1 | | 2/2003 | Pettibon | |

* cited by examiner

*Primary Examiner*—Quang D. Thanh
(74) *Attorney, Agent, or Firm*—Ramon L. Pizarro; Edwin H. Crabtree

(57) ABSTRACT

A neck traction device for delivering or imposing a tension force on the neck area of a person. The traction device includes a rigid vertical support member that has a connector for engaging a support surface. A neck cradle having a pair of rigid spaced apart arms adapted for engaging the scull at a location below the occipital bone is mounted from the rigid vertical member to allow a person to use his weight against the cradle to impose a tension force on the person's neck.

1 Claim, 4 Drawing Sheets

NECK TRACTION SYSTEM

BACKGROUND OF THE INVENTION (a) Field of the Invention

This invention generally relates to a system for exerting a tension force along the neck area of a human. More particularly, but not by way of limitation, to a traction device that is used to pull a person's skull away from the base of the neck in order to relieve pressure between vertebra of the neck.

(b) Discussion of Known Art

A common treatment for pain caused by damage or infirmity of the neck area of the spine has been to stretch or pull on the spine in order to relieve pressure or align components of the spine. This pulling or tension on the spine is typically induced by placing weights on a lever or pulley system, which in turn transmits this tension load to the person's head. The connection of this system to the person's head is typically a harness that includes a strap or the like that engages the person's jaw, and transmits the tension load to the person's head through the jaw.

An examination of the attachment of the jaw to the human skull, the temporo-mandibular joint, reveals that the jaw is held in place by muscles that surround a relatively small contact area that is cushioned by a small cartilage disk. The entire joint is balanced and precisely adapted to withstand the loads imposed by chewing. The use of this joint to transfer the loads for obtaining the effects of traction by pulling on a person's head can easily overload temporo-mandibular joint, causing additional pain to the person who already suffers from spine ailments.

Still further, the use of a strap or other device that transfers loads through a person's jaw is very uncomfortable for the user. The pressure imposed on the jaw forces the jaw closed, making it difficult to breathe and impossible to speak without difficulty.

Examples of known devices can be found in the following U.S. patents:

| U.S. Pat. No. | Inventor | Date of Issue |
|---|---|---|
| 6,517,506 | Pettibon | Feb. 11, 2003 |
| 4,869,240 | Boren | Sep. 26, 1989 |
| 3,403,675 | Carr | Oct. 1, 1968 |
| 2,938,695 | Ciampa | May 31, 1960 |
| 2,843,114 | Hall | Jul. 15, 1958 |
| 2,808,049 | Graham | Oct. 1, 1957 |
| 2,701,564 | Wilhelm | Feb. 8, 1955 |
| 2,658,506 | Haskell | Nov. 10, 1953 |
| 1,425,433 | Zook | Aug. 8, 1922 |

As indicated above, these patents consistently advocate the use of a chin strap, or strap that extends across the front of the neck. Accordingly, there is a need for a device that can provide traction to the neck area without pulling or pressing against the person's jaw.

Still further, a review of known devices reveals that it is well accepted that the way to provide pressure or pull on the neck is by providing weights. The weight of these weights is transmitted by way of cables and pulleys to a harness that transmits the load the person's neck through the harness.

Therefore, a review of known devices reveals that there remains a need for a device that allows a person to provide traction to the neck and upper spine area without having to impose pressure on the jaw area.

There remains a need for a neck traction device that allows the user to control the amount of weight or tension by simply shifting his weight, thereby providing the user great deal of precise control of the amount of force-transmitted to the neck area.

SUMMARY

It has been discovered that the problems left unanswered by known art can be solved by providing a traction device that exerts a tension force on the neck area of a person, the traction device includes:

a rigid vertical support member, the rigid vertical member including a connector for engaging a support surface; and a neck cradle, the neck cradle having a pair of rigid spaced apart arms adapted for engaging the scull at a location below the occipital bone, the neck cradle being mounted from the rigid vertical member.

In one example of the invention, a head strap is provided to stabilize the head over the spaced apart arms. Additionally, it is contemplated that the neck cradle will be moveable along the rigid vertical support member. The rigid vertical support member will in turn be supported from a door, chair, or a floor-mounted support. The position of the neck cradle relative to the rigid vertical support member will be set by the user to allow the user to insert his neck into the cradle so that the rigid spaced apart arms of the cradle extend below the occipital region of the user's skull and terminate at or near the user's jaw. Once the user's head has been inserted into the cradle the user will then use his body weight to provide the tension load to provide the traction effect on the neck area.

The rigid vertical support member may be formed as a single beam or a set of parallel beams that can be held in a generally upright, vertical orientation. The position of the cradle relative to the vertical support member may be adjusted by providing sliding support of the cradle by the vertical support member, by simply providing varied attachment positions for the cradle on the vertical support member, or by simply making the length of the vertical support member of adjustable length. Thus, it is contemplated that various arrangements may be used. For example, the length may be adjusted by using parallel telescoping or sliding beams that provide length adjustment and stability to the device. The length adjustment may be provided by hydraulic or pneumatic cylinders, screw actuators, geared actuators, or other actuation devices.

The tension load imposed by the cradle on the occipital bone of the cranium will be reacted by the vertical support member. This reaction may in turn be reacted as a tension load on a portion of the vertical support member extending above the cradle or as a compression load on a portion of the vertical support member extending below the cradle. In the event that the load from the cradle is reacted as a tension load on the vertical support member, it is contemplated that this tension load may be transmitted to the upper edge of a door or doorway, or a wall support, or other overhead structure. It is contemplated that attachment to a doorway or the like can be accomplished by using a hook, a clamp, or other fastening mechanism that can transfer the tension load into a suitable overhead support.

In the event that the load from the cradle is transferred below, as a compression load, the force traveling through the vertical support member may be reacted through the back of a chair, through a stand, or even through the user's shoulders. In the event that the vertical load is being reacted through the back of a chair, the vertical support member may be built into the back of the chair or fastened to the chair. With this example the user would simply adjust the height of the cradle such that the distance from the cradle to the chair is slightly longer than the distance between the base of the user's skull, and then position his head in the cradle to allow his weight to impose a tension load on the neck and spine area.

According to other examples disclosed herein, the location of the arms or cradle relative to the user's shoulders will be adjustable. These adjustments will allow the user to introduce a tension load into the neck area. Adjustment may be accomplished by way hydraulic cylinders, screw advance devices, telescoping devices, geared devices, as well as other linear actuation means.

It should also be understood that while the above and other advantages and results of the present invention will become apparent to those skilled in the art from the following detailed description and accompanying drawings, showing the contemplated novel construction, combinations and elements as herein described, and more particularly defined by the appended claims, it should be clearly understood that changes in the precise embodiments of the herein disclosed invention are meant to be included within the scope of the claims, except insofar as they may be precluded by the prior art.

DRAWINGS

The accompanying drawings illustrate preferred embodiments of the present invention according to the best mode presently devised for making and using the instant invention, and in which.

DETAILED DESCRIPTION OF PREFERRED EXEMPLAR EMBODIMENTS

While the invention will be described and disclosed here in connection with certain preferred embodiments, the description is not intended to limit the invention to the specific embodiments shown and described here, but rather the invention is intended to cover all alternative embodiments and modifications that fall within the spirit and scope of the invention as defined by the claims included herein as well as any equivalents of the disclosed and claimed invention.

Figure 1:
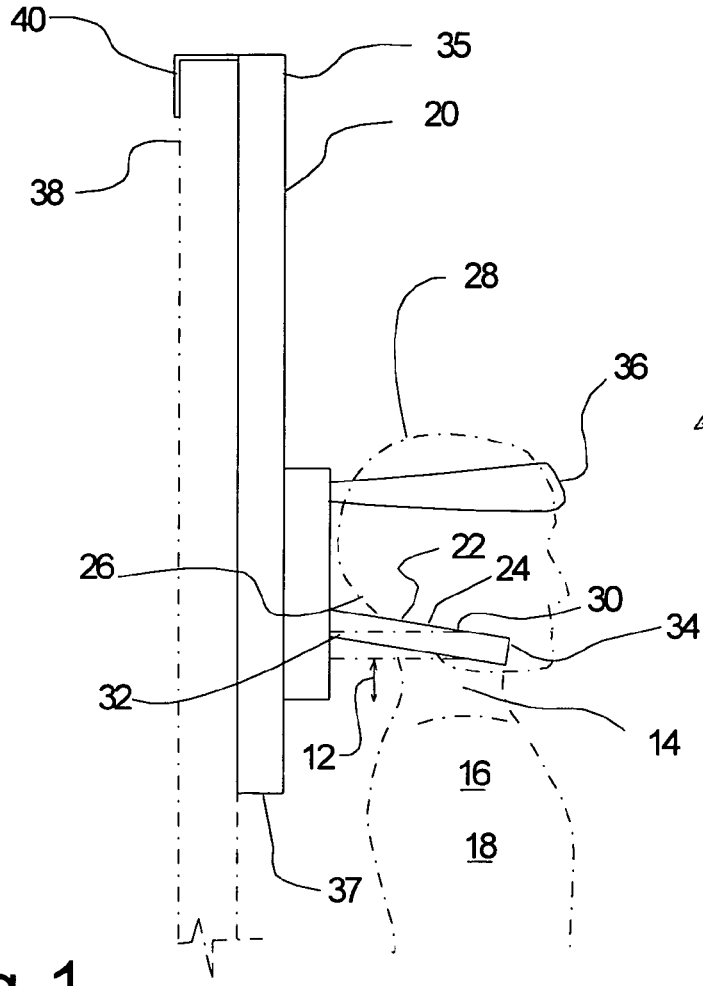
FIG. 1 is a side view of an embodiment of the invention while in use with a doorway.

Turning now to FIG. 1 where a traction system 10 for exerting a tension force 12 on the neck area 14 of a person 16. The system is particularly well suited for placing a tension force in the cervical vertebra, especially in the neck area. The system uses part of the weight of the person's torso 18 for inducing the tension force or load on the cervical vertebra or neck. As illustrated, it is contemplated that the system will use a rigid vertical support member 20 that is used to resist the force imposed by the weight person's torso.

As illustrated in FIG. 1, the rigid vertical support member 20 is used to support a neck cradle 22 that has been adapted for supporting the person's head through the mastoid process area 24, below the occipital bone 26 of the skull 28. It is contemplated that the neck cradle 22 will include a pair of rigid spaced apart arms 30, each arm 30 having a first end 32 and a second end 34. The first end 32 of each of the spaced apart arms 30 is cantilevered from the rigid vertical support member 20. It is important to note that while it is contemplated that the arms 30 will be mounted as part of a cradle 22, it is also contemplated that the arms 30 may be attached directly to the vertical support member 20.

Also illustrated in FIG. 1 is that the arms 30 have been supported from the vertical support member 20 positioned for engaging the scull 28 at a location below the occipital bone 26. Additionally, the position of the neck cradle 22 or arms 30 are held between the upper end 35 and the lower end 37 of the rigid vertical support member 20. It is contemplated that the position of the cradle 22 or the arms 30 along the rigid vertical support member 20 can be adjusted. This allows the user to position the arms 30 at a position from the ground that will allow the user to back into the device, allowing the arms 30 to engage the skull below the occipetal bone, as discussed above. Once the head is positioned over the arms 30, the user then stabilizes his head by placing a head band 36 or head support strap across his forehead. Once the user's head is over the arms 30 and stabilized by the head band 36, the user then relaxes his body, transferring at least some of the user's weight on to the arms 30. Thus the user's weight is used to impose a tension load on the user's neck area. Additionally, the rigidity and support provided by the system 10 provides full support of the head, allowing full relaxation of the neck muscles.

It is contemplated that the traction system 10 will in-turn be supported from an elevated support member 38, such as a door or an overhead structural member or the like. To support the traction system 10 from the elevated support member 38, a connector 40 for engaging a support surface or support member 38 has been illustrated in use with the system 10. Of course, the connector 10 would be selected depending on the support surface being used to support the system 10. Thus, it is contemplated that in addition hooks and the like, devices such as clamps, mechanical fasteners, adhesives and devices such as hook and loop materials may also be used where appropriate.

Figure 2:
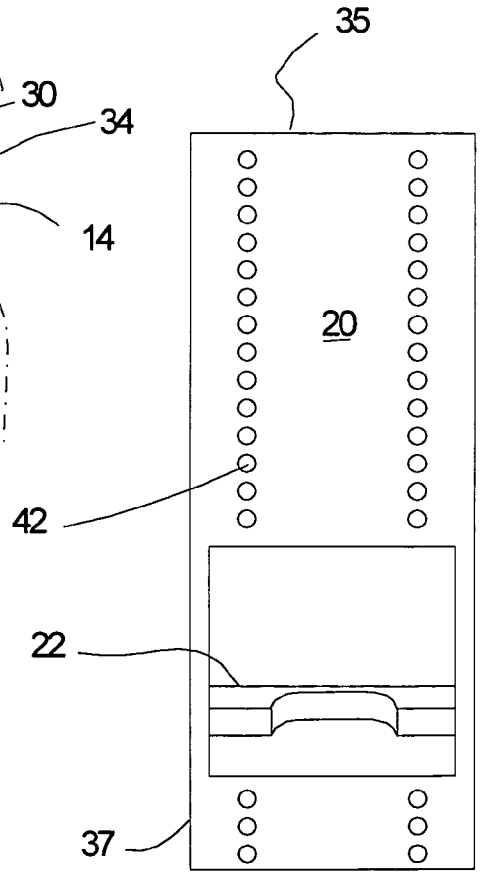
FIG. 2 is an elevational view of the device as illustrated in FIG. 1, while mounted on a door.
Figure 3:
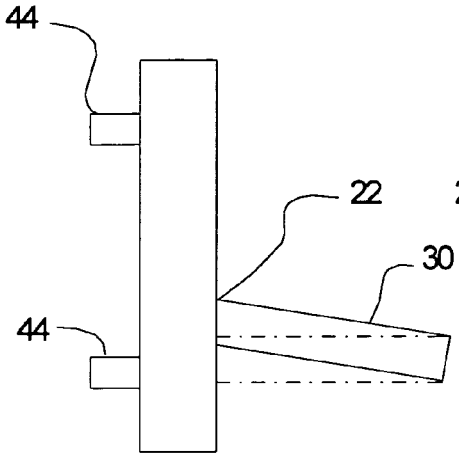
FIG. 3 is a side view of an example of a carriage used with the disclosed invention.
Figure 4:
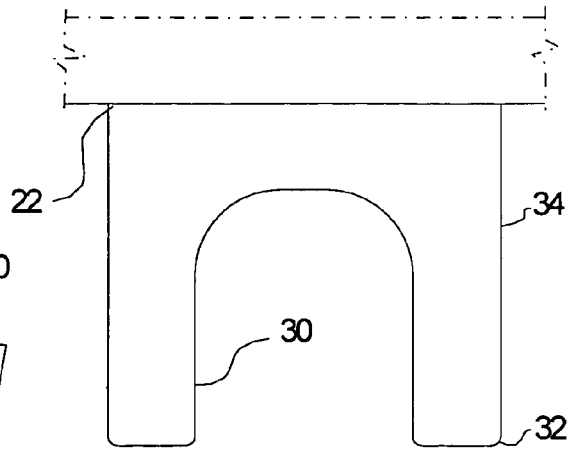
FIG. 4 is a view looking down at the example of the spaced apart arms of the neck cradle shown on FIG. 3.

Turning now to FIGS. 2–4, it will be understood that according to one example of the invention the neck cradle 22 will be mounted from a vertical support member 20 that includes a pair of vertical adjustment holes 42 or tracks that provide stable support of the cradle 22 as well as adjustability of the location of vertical support of the cradle 22. FIG. 3 illustrates that in this example the cradle 22 includes pegs 44 or other engagement protrusions that are inserted into the holes 42 to support the cradle 22 from the vertical support member 20. Additionally, FIG. 3 illustrates that the support arms 30 may be at a right angle to the cradle 22 or vertical support member 20, but may be at some other angle that is close to being a right angle. FIG. 4 is a view looking down, illustrating the protrusion of the support arms 30 from the cradle 22.

Figure 5:
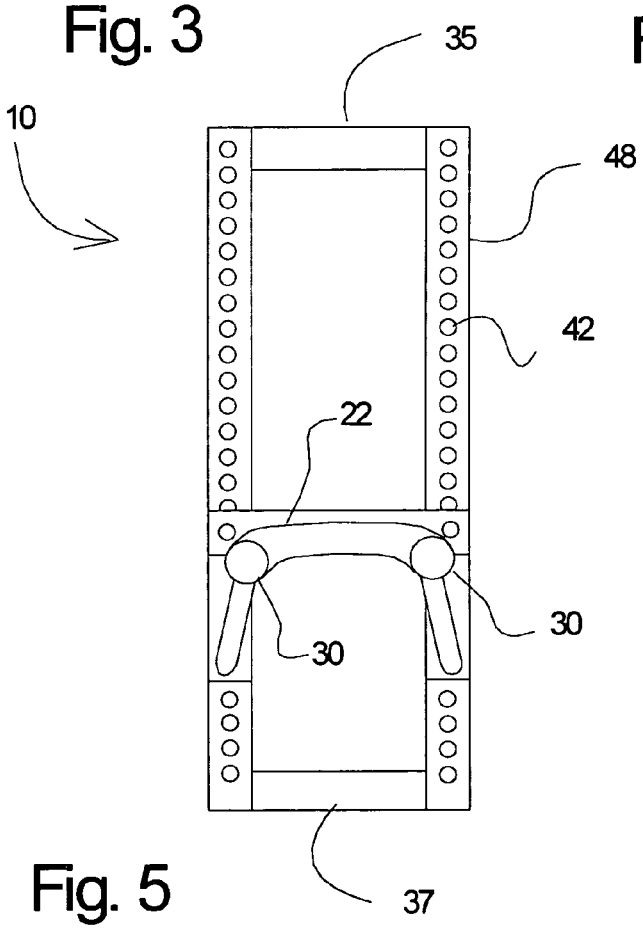
FIG. 5 is an elevational view of an example of the invention, which uses a pair of rigid vertical support members to support the carriage.

Turning to FIG. 5 it will be understood that it is contemplated that the parallel support arrangement illustrated in FIG. 2 may be achieved by using a pair of vertical beams 48 that include apertures, tracks or other adjustment devices. Thus, in the example illustrated in FIG. 5, the cradle 22 may be slidably supported from the beams 48, and the position of the cradle along the beams 48 adjusted by the insertion of pins or clamping devices through the cradle 22 and into or against the beams 48.

Figure 6:
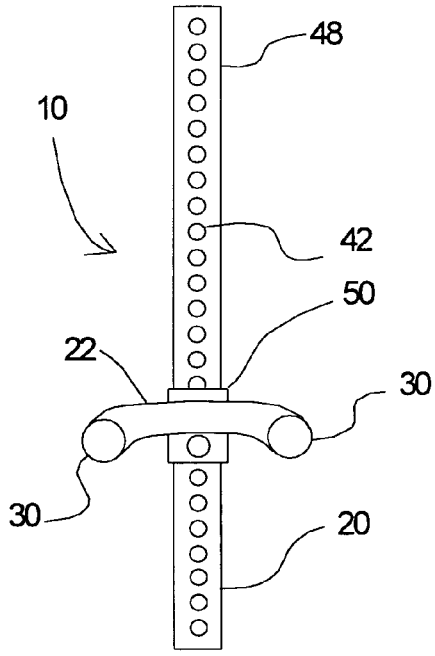
FIG. 6 is yet another example of the disclosed invention. The example including a single rigid vertical support member.

FIG. 6 illustrates the use of a single beam 48 as a vertical support member 20. In this example the arms 30 are formed from a single piece and attached to a sliding support 50 to create the cradle 22, or may be attached directly against the beam 48 by way of a removable connector, such as a pin or the like, or may be fixed against the beam 48, with the beam 48 being of adjustable length. Adjustability of the length of the beam 48 may be achieved by a telescoping arrangement, threaded or screw mechanism, or other known mechanism for extending the length of the beam 48.

Figure 7:
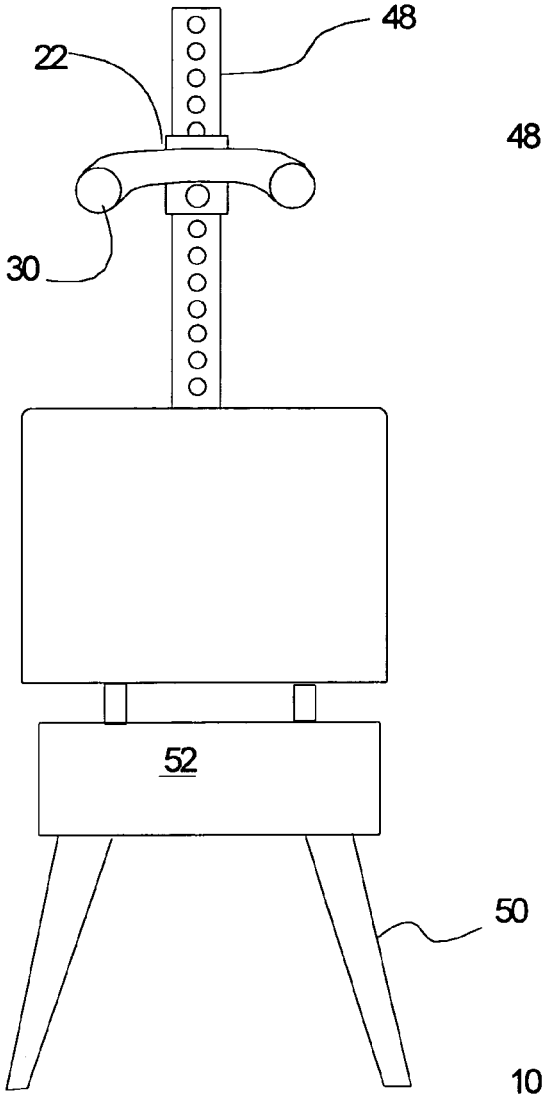
FIG. 7 is an example of a chair that incorporates the inventive aspects taught herein.

FIG. 7 illustrates the use of the example shown on FIG. 6 supported from the back of a chair 50. With this example the user would simply adjust the height of the arms 30 over the seat 52 such that some of the user's weight is supported by the arms 30, thereby transmitting a tension force on the user's neck area. In order to further stabilize the user's head while using the disclosed invention, it is contemplated that a head band 36 may also be used with the example shown in FIG. 7. The head band 36 would be attached to the cradle 22 or the beam 48.

Figure 8:
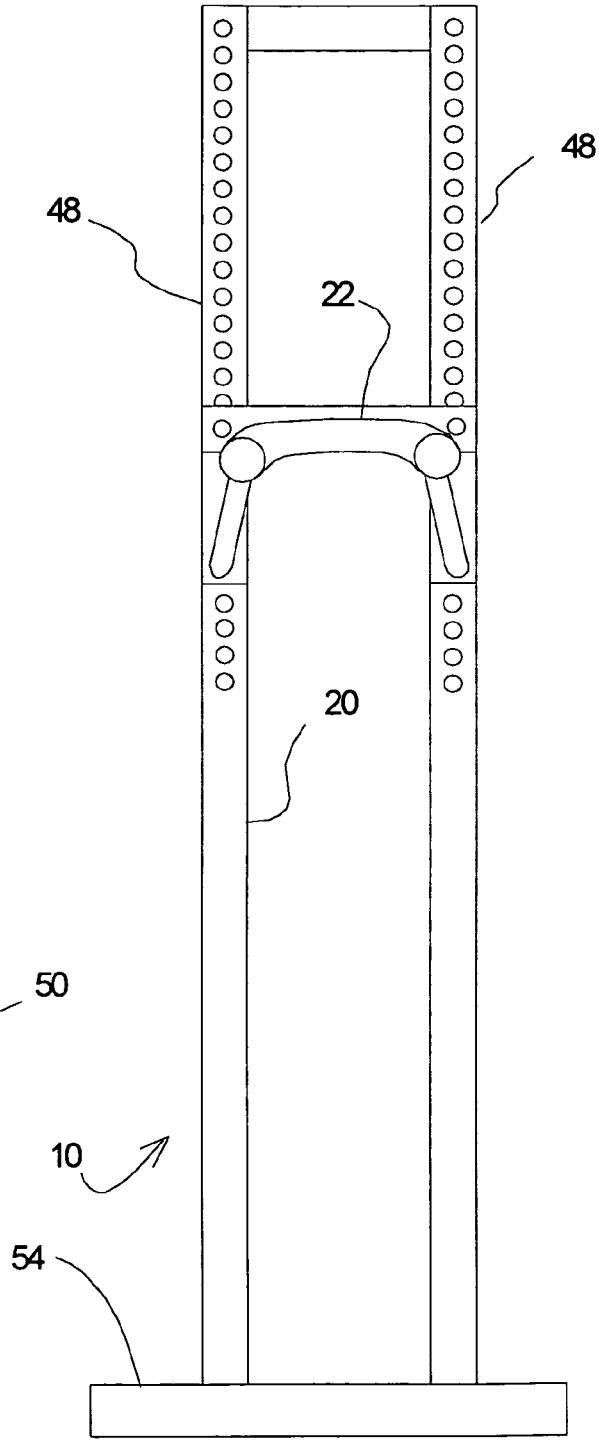
FIG. 8 is an elevational view of a floor mounted example of the disclosed invention.

Turning to FIG. 8 it will be understood that it is contemplated that a base 54 may be used to support the vertical support member 20 from the floor, and thus obviating the need to use a support for suspending the system 10 from an elevated support structure.

Figure 9:
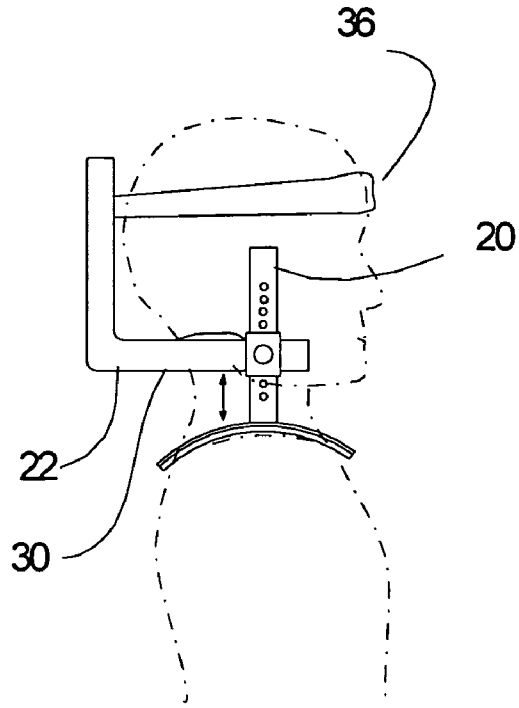
FIG. 9 illustrates another example of the disclosed invention, the example using the wearer's shoulders to support the device while in use.
Figure 10:
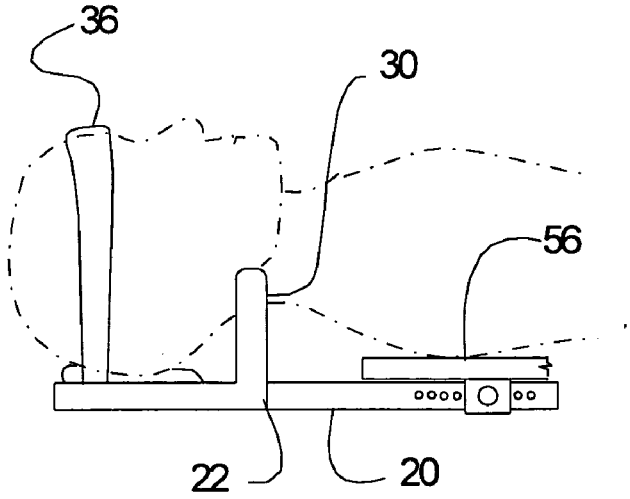
FIG. 10 illustrates the use of principles taught herein for a device used while lying down.

FIGS. 9 and 10 provide additional examples of how to use the principles taught herein. In FIG. 9 the cradle 22 is pushed up from the user's shoulders. The arms 30 will be urged up against the mastoid process area as described above. Additionally, in order to stabilize this example, it is contemplated that the head band 36 will be attached to the cradle 22 such as illustrated. FIG. 10 illustrates the use of the carriage while the user is lying down. In this example the vertical support 20 is attached to a torso support 56. To use this embodiment the user would simply lay his head into the cradle 22 and then move his body away from the cradle. Alternatively, the user may place his head in the cradle and the vertical support 20 slid away from the torso support 56 until the appropriate tension is achieved.

Thus it can be appreciated that the above described embodiments are illustrative of just a few of the numerous variations of arrangements of the disclosed elements used to carry out the disclosed invention. Moreover, while the invention has been particularly shown, described and illustrated in detail with reference to preferred embodiments and modifications thereof, it should be understood that the foregoing and other modifications are exemplary only, and that equivalent changes in form and detail may be made without departing from the true spirit and scope of the invention as claimed, except as precluded by the prior art.

What is claimed is:

1. A traction system for exerting a tension force on a neck area of a person having a torso of a weight and a skull having mastoid process area, occipital bone and jaw, the traction system comprising:

a rigid vertical support member having an upper end and a lower end, the upper end of the rigid vertical support member including a hook adapted for supporting the traction system from an overhead support surface in a vertical position above the person's skull, the rigid vertical support member further having a plurality of holes between the upper end and the lower end;

a neck cradle having a pair of rigid spaced apart arms projecting from the neck cradle, each arm having a first end and second end, the first end of each of the spaced apart arms being cantilevered at an angle ranging from about perpendicular to member is in a vertical position, and the spaced apart arms being adapted for engaging the skull between the arms at a location below the occipital bone, the neck cradle being selectively attached to the rigid vertical support member through at least one peg that extends from the cradle and cooperates with the holes in the rigid vertical member to allow adjustment of the position of the cradle along the rigid vertical support member;

and a head support strap that extends from the neck cradle, the head support strap retaining the person's head against the cradle and on the arms so that the head does not slide out of the cradle, so that the person can adjust the position of the cradle along the rigid vertical support member and place his head in the cradle and use of the weight of the torso to impart the tension force on the neck area.

* * * * *